US005095978A

United States Patent [19]

Akkerman et al.

[11] Patent Number: 5,095,978

[45] Date of Patent: Mar. 17, 1992

[54] HYDRAULICALLY OPERATED PERMANENT TYPE WELL PACKER ASSEMBLY

[75] Inventors: Neil H. Akkerman; Aubrey C. Mills, both of Houston, Tex.

[73] Assignee: AVA International, Tex.

[21] Appl. No.: 656,414

[22] Filed: Feb. 15, 1991

Related U.S. Application Data

[63] Continuation of Ser. No. 396,560, Aug. 21, 1989, abandoned.

[51] Int. Cl.[5] ..... E21B 23/06

[52] U.S. Cl. ..... 166/120; 166/134; 166/182; 166/387

[58] Field of Search ..... 166/120, 381, 386, 387, 166/126, 134, 135, 138, 143, 179, 182, 194, 196, 187, 208, 212

[56] References Cited

U.S. PATENT DOCUMENTS 4,224,987 9/1980 Allen ..... 166/179

4,754,814 7/1988 Jordan, Jr. ..... 166/387

4,832,129 5/1989 Sproul et al. ..... 166/123

*Primary Examiner*—Terry Lee Melius

*Attorney, Agent, or Firm*—Vaden, Eickenroht, Thompson & Boulware

[57] ABSTRACT

There is disclosed a well packer assembly which comprises a packer which includes a body having a bore therethrough and a packing element and slips carried about the body in contracted position. The packer is lowered into a well bore by means of a locator seal unit which includes a tubular member connectable as part of a well tubing and extending sealably within the bore of the tubular member. The tubular member is automatically released from its connection to the packer in response to expansion of the packing element and slips into engagement with the well bore and testing of the set packer by means of test fluid in the annulus above it. The packing element and slips are expanded by inhibitor fluid from a source at surface level, and the inhibitor fluid is released into the annulus below the packer after it is set.

19 Claims, 5 Drawing Sheets

HYDRAULICALLY OPERATED PERMANENT TYPE WELL PACKER ASSEMBLY

BACKGROUND OF THE INVENTION

This application is a continuation of our copending patent application, Ser. No. 07/396,560, which was filed on Aug. 21, 1989 and entitled "Hydraulically Operated Permanent Type Well Packer Assembly", now abandoned.

FIELD OF THE INVENTION

This invention relates generally to an hydraulically actuated permanent type well packer assembly, and, more particularly, to improvements in an assembly of this type in which the packer is lowered into the well bore by a locator seal unit connected as part of the well tubing, and then released therefrom, following setting of the packer, to permit the seal unit and well tubing to move vertically with respect thereto and thus raised from the well bore if desired. In one of its aspects, this invention relates to an improved assembly of this type for use in a well in which inhibitor fluid is to be injected into the annulus below the packer.

DESCRIPTION OF THE RELATED ART

In the completion of an oil or gas well, a well tubing is packed off within a well bore to enable well fluid from a formation below the packer to be produced through the tubing. The packer may be of the permanent type in the sense that its packing element and slips are locked in expanded position against the well bore. Conventionally, the packing element and slips are carried in retracted positions intermediate upper and lower shoulders about the body of the packer, as the packer is lowered into the well bore, and a piston is arranged within a cylinder in the packer body to move one shoulder toward the other in order to axially compress and thus expand the packing element and slips when hydraulic fluid is supplied to the cylinder. The packer is then automatically locked in its set position by a body lock ring disposed between the expanding means and packer body.

The tubing, which is suspended from the wellhead, must be free to move vertically with respect to the set packer in order to compensate for its expansion and contraction due to temperature changes within the well bore. Also, there are occasions in which the operator may wish to lift the tubing from the well bore. In some cases, the packer is first lowered into and set within the well bore, and the tubing is then lowered into the bore and through a seal bore within the body of the packer. However, well packer assemblies of the type above described, wherein the packer is lowered on the locator seal unit, are preferred inasmuch as they avoid the time and expense of separately running and landing each of the packer and well tubing.

In prior assemblies of this type, the packer body has been supported from the tubular member of the seal unit by pins which may be sheared prematurely, as, for example, due to drag on the packer as it is moved vertically within the well bore. Hence, the packer may be released from the locator seal unit and thus be lost in the well before the packer is set.

An object of this invention is to provide such an assembly in which the packer is so connected to the locator seal unit as to prevent release due to drag on the packer or other phenomenon which might release a shearable connection between them prior to setting of the packer.

Corrosive substances in the well fluid may, if unheeded, cause damage to the tubing in and around the producing formation. It is therefore often desirable to inject a corrosion inhibitor fluid into the annulus of the well beneath the packer so that it will circulate downwardly past the lower end of the tubing and then upwardly within the tubing.

A further object of this invention is to provide an hydraulically set permanent type packer assembly of this type which is especially well suited for use in the completion of a well in which the need for injection of such fluid is anticipated, and, more particularly which is of such construction that the such fluid serves to set the packer prior to its injection into the annulus.

SUMMARY OF THE INVENTION

These and other objects are accomplished, in accordance with one aspect of the present invention, by a well packer of the type described wherein the packer body is so connected to the tubular member as to be released therefrom only upon setting of the packer and subsequent testing of the set packer by the injection of test pressure in the annulus above the packer. Thus, the operator need not be concerned with release of the packer prior to being set, as might occur in prior art assemblies in which the packer is connected to the seal unit by shearable pins.

More particularly, in the preferred and illustrated embodiment of the invention, the packer body is connected to the tubular member of the seal unit by means which holds the packer body and tubular member against movement in either longitudinal direction with respect to one another, and means for releasing the tubular member for movement in one longitudinal direction opposite that in which the piston means is movable within cylinder means for the purpose of expanding the packing element and slips, in response to such movement of the piston means, and then releasing the tubular member for movement in such one longitudinal direction with respect to the packer body, in response to release and movement of the tubular member in the opposite direction. Thus, the packer is released from the seal unit only upon initiation of expansion of the packing element and slips and subsequent lowering or movement of the tubular member in a direction opposite to that in which the piston is moved, as occurs automatically in response to testing of the packer.

The means for holding the packer and tubular member includes first means holding the packer body against movement in the opposite longitudinal direction with respect to the tubular member, and second means holding the packer body against movement in the one longitudinal direction with respect to the tubular member. More particularly, the releasing means includes means for releasing said second holding means in response to movement of the piston means in such one longitudinal direction to expand the assembly, and means for releasing the first holding means in response to movement of the tubular member in the opposite longitudinal direction with respect to the packer body, which, as above described, occurs automatically in response to testing of the packer.

The first holding means comprises a first shoulder on the packer body facing in the longitudinal opposite direction and a first shoulder on the tubular member facing in the one longitudinal direction, as well as a first ring means which is held between the packer body and tubular member intermediate the first shoulders. The second holding means comprises a second shoulder on the body facing in the one direction, and a second shoulder on the tubular member facing in the opposite direction, together with a second ring means which is held between the body and tubular member intermediate the second shoulders. More particularly, the tubular member has a recess into which the first ring means may move upon movement of the body in the one direction with respect to the tubular member so as to permit the tubular member to then be moved in the one direction with respect to the body, and the body has a recess into which the second ring means may move upon movement of the piston means in the one direction with respect to the body so as to then permit the tubular member to move in the opposite direction with respect to the body.

In the illustrated and preferred embodiment of the invention, the second ring means comprises a C-ring which is inherently expandable from an inner position to an outer position within the recess of the body, and the means for releasing the C-ring comprises pins extending through the packer body and into the recess in the body for engaging the C-ring, together with a sleeve releasably connected about the body intermediate the packing element and slips and the other shoulder on the body so as to radially confine the pins and thus retain the C-ring in retracted position. The sleeve has a recess into which the pins are moved by the expanding C-ring when the sleeve is moved vertically in the one direction with respect to the body by movement of the expanding packing element and slips in the one longitudinal direction. The packer body has gauge surfaces thereabout above and below the sleeve which project radially outwardly beyond the sleeve to protect the sleeve against inadvertent release of its connection to the packer body during reciprocation of the packer within the well bore. The first ring means comprises another C-ring which is inherently retractable from an outer position into the recess and the tubular member when opposite thereto.

As illustrated, the piston means is arranged to move upwardly in response to the supply of hydraulic fluid to its lower end, and the other shoulder of the packer body faces downwardly to limit the upward movement of the sleeve. As will be apparent from the description to follow, however, this arrangement could be reversed in that the piston means could move downwardly with respect to the packer body in response to the supply of hydraulic fluid to its upper end, and the other shoulder in the packer body could face upwardly to limit downward movement of the sleeve.

In accordance with another novel aspect of the present invention, a means is provided for introducing inhibitor fluid from a source at the surface into a fluid chamber which connects with the cylinder means in order to move the piston means in its one expanding direction, and a means is provided for releasing the inhibitor fluid for flow into the annulus beneath the packer when the pressure thereof is raised above that necessary to set the packer. Thus, in the illustrated and preferred embodiment of the invention, a plug is held within an opening connecting the chamber with the annulus beneath the expanded packing element, but releasable therefrom, in response to raising of the pressure of inhibitor fluid in the chamber, so as to permit inhibitor fluid to pass downwardly into the annulus below the set packer.

In the illustrated and preferred embodiment of the invention, the opening is an annular space, and the plug is an annular sleeve sealably slidable within the space, the plug being held within the opening by releasable shear means connecting the sleeve to one of the tubular member and packer body. The annular opening is formed between the tubular member and body, and the sleeve has an outer diameter which is less than the inner diameter of the bore of the packer body to permit it to be raised with the well tubing from within the bore of the packer.

The locator seal unit includes valve means which is normally held in a position closing the passageway means so that gas at atmospheric pressure may be contained between the valve means and piston means, whereby fluid in the well bore is effective to maintain the piston means in its lower position prior to setting of the packer. The valve means includes a closure member which is sealably slidable within a bore in the passageway means, and is released for movement to open position, in response to an increase in the inhibitor fluid pressure at one end of the closure member so as to open the passageway means and thus admit inhibitor fluid at the higher pressure to the cylinder means, and means are provided for automatically holding it in its open position when moved thereto, thus converting the sealing means to static seals, and the bore in the passageway means on the opposite end of the closure member is connected with the bore of the tubular member, thus in effect pressure balancing the closure member prior to raising of the inhibitor fluid pressure.

BRIEF DESCRIPTION OF THE DRAWINGS

In the drawings, wherein like reference characters are used throughout to indicate like parts.

DESCRIPTION OF THE PREFERRED EMBODIMENT

Figure 2A:
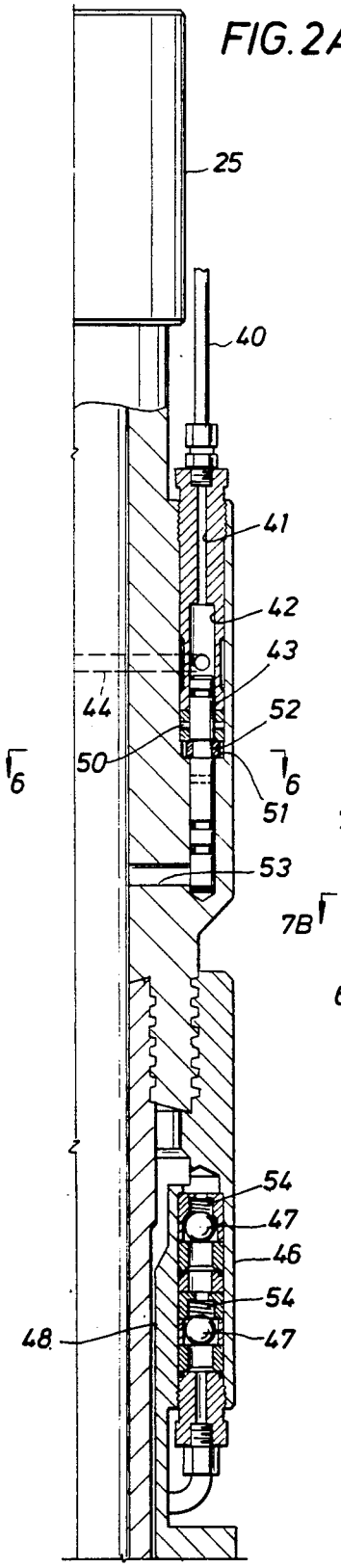
FIGS. 2A, 2B and 2C are similar views of the assembly, with FIG. 2A showing the upper end of the assembly and FIGS. 2B and 2C showing successively lower portions thereof, and wherein the packing element and slips have been expanded into engagement with the well bore, and the tubular member of the locator seal unit has been released for lowering with respect to the packer, in response to the supply of inhibitor fluid downwardly through passageways in the seal unit to a piston within a cylinder formed in the packer body beneath the packing elements and slips.
Figure 2B:
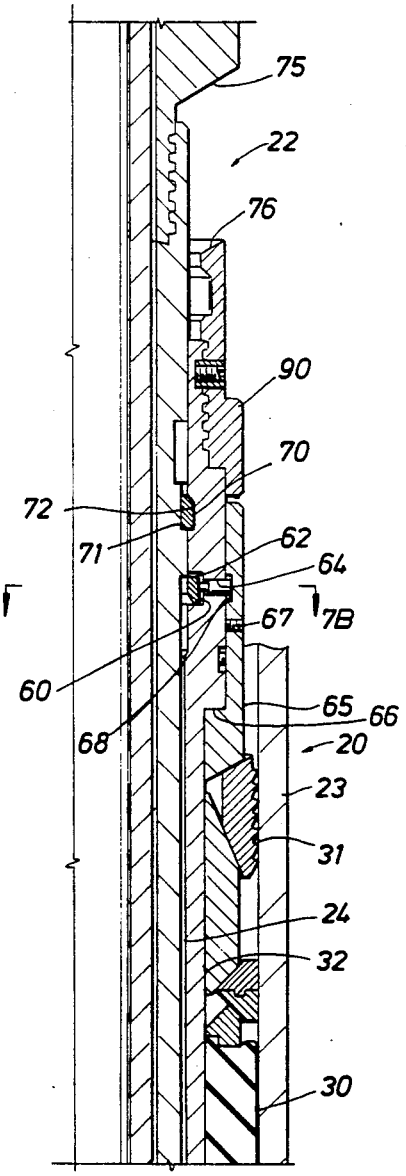
Figure 2C:
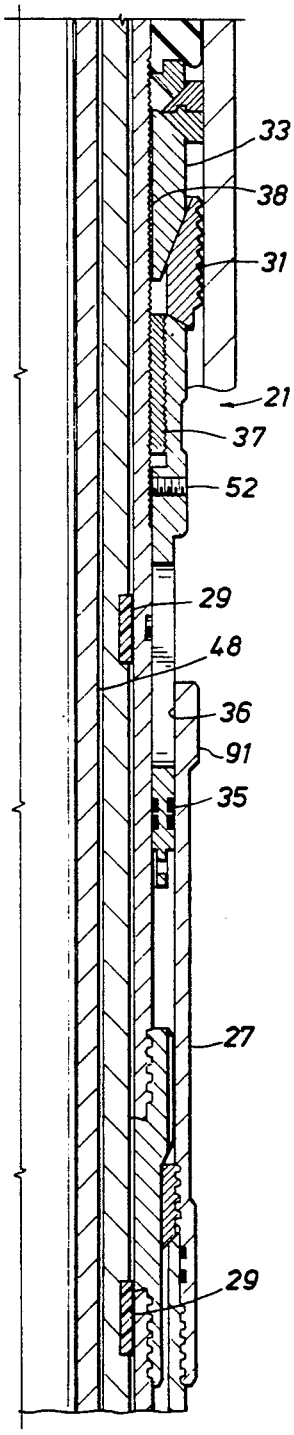

With reference now to the details of the above described drawings, the overall well packer assembly, which is indicated in its entirety by reference character 20, is shown to comprise a packer 21 of the type described and a locator seal unit 22 connected as part of a well tubing and extending sealably through and releasably connected to the packer in order to lower the packer with it into the well bore WB, which, as shown in FIGS. 2B and 2C, may be a well casing 23.

Figure 1A:
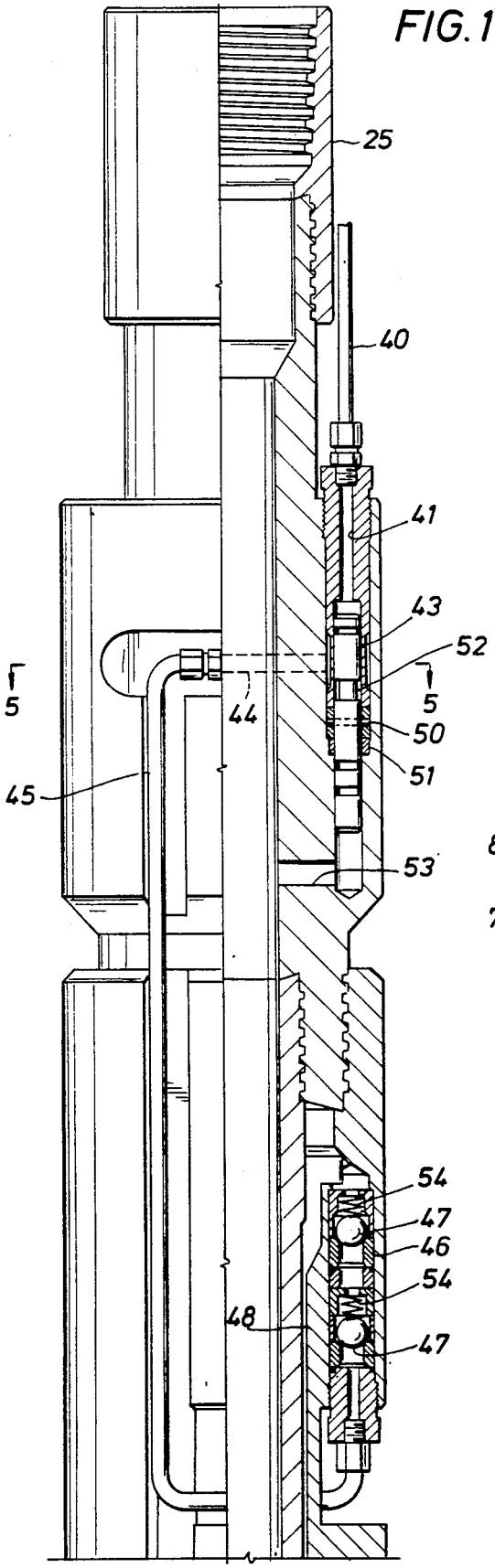
FIGS. 1A, 1B, 1C and 1D are partial side views of an assembly constructed in accordance with the present invention, partly in vertical section and partly in elevation, with FIG. 1A showing the upper end of the assembly, and FIGS. 1B, 1C and 1D showing successively lower portions of the assembly, and wherein the assembly is shown with the packing element and slips in contracted positions during lowering into a well bore.
Figure 1B:
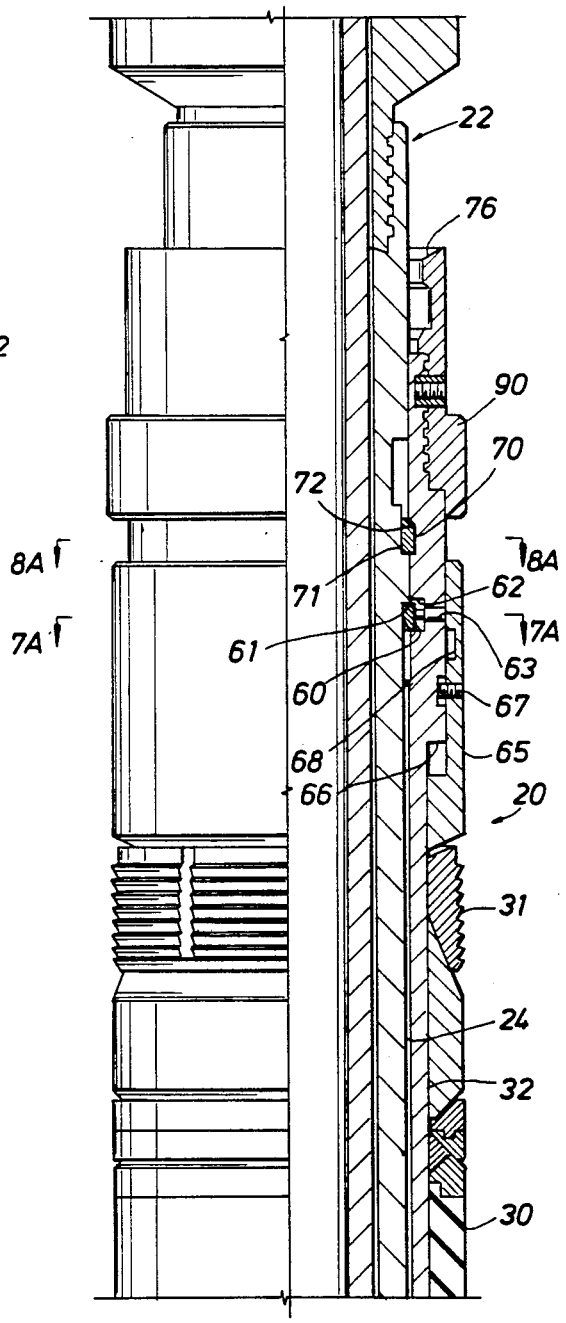
Figure 1C:
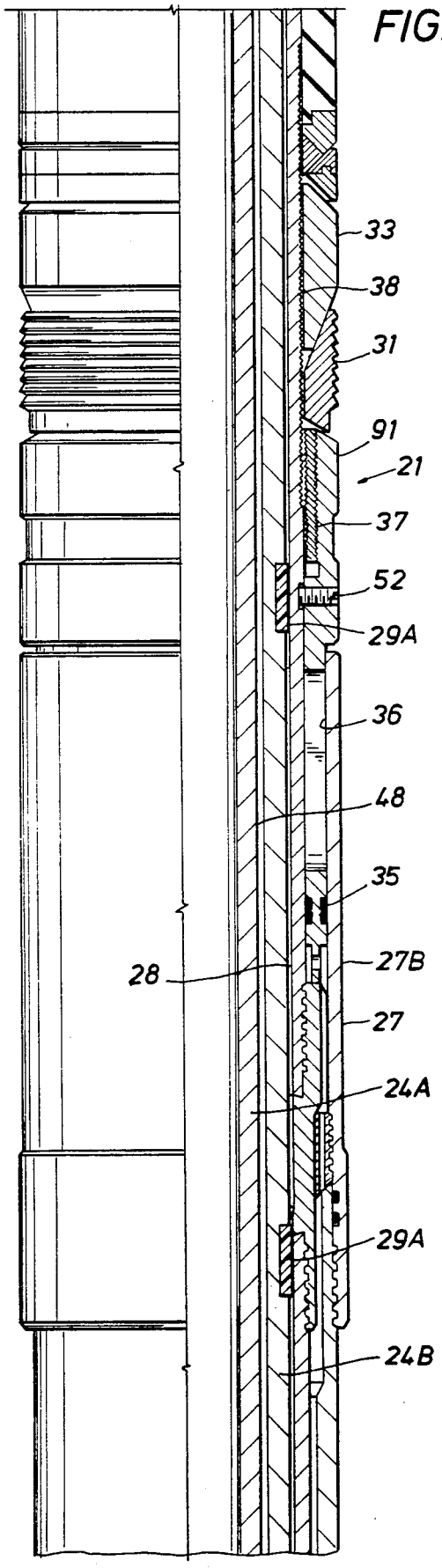
Figure 1D:
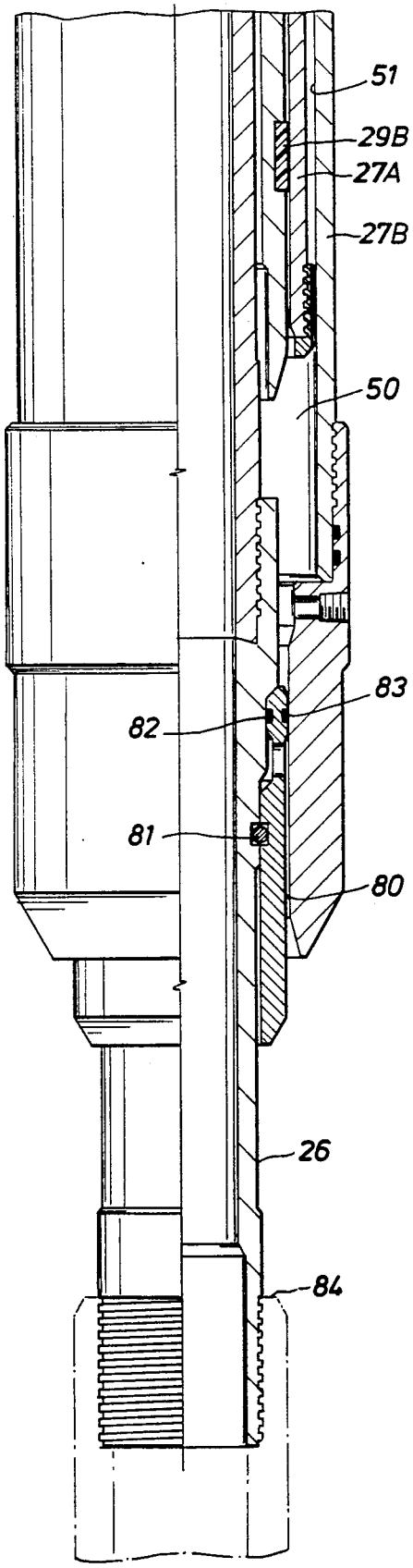

The locator seal unit comprises a tubular member 24 which has female threads at its upper end 25 for connection to the lower end of an upper portion of the well tubing, and male threads on its lower end 26 for connection to the upper end of a lower portion of the well tubing (see broken lines of FIG. 1D). The packer 21, on the other hand, includes a packer body 27 having a bore 28 through which the tubular member extends and to which the tubular member is releasably connected in a manner to be described in detail to follow. Wiper rings 29A and packing 29B are carried about the tubular member for sealably engaging the bore of the packer body, the packing closing off the well bore when the packer is set.

As is conventional in permanent type packers, a packing element 30 and slips 31 are carried about a reduced diameter portion 32 of the packer body in the normally contracted positions of FIGS. 1B and 1C as the packer is lower into the well bore. More particularly, packing element 30 is disposed vertically intermediate upper and lower expander rings 33 having conically shaped outer surfaces over which the upper and lower slips 31 are slidable.

The packing element and slips are arranged vertically between a downwardly facing limit shoulder on the packer body above the reduced diameter portion 32 thereof and an upwardly facing limit shoulder on the upper end of an annular space between inner and outer walls of the packer body to form piston 35 movable vertically within an annular cylinder 36 the packer body beneath the piston. As the piston moves upwardly relative to the cylinder, the slips are forced outwardly toward the well bore and the packing element 30 is squeezed between the expander rings to set the packer, as shown in FIGS. 2B and 2C.

As the piston moves upwardly to expand the packing element and slips, a body lock ring 37 carried on its upper end engages teeth 38 about the reduced diameter of the packer body so as to lock the packing element and slips in expanded position. The pressure of well fluid in the annulus about the packer urges the piston downwardly, so that as long as fluid pressure within the cylinder is less than well fluid, the packing element and slips remain in their contracted position.

Figure 5:
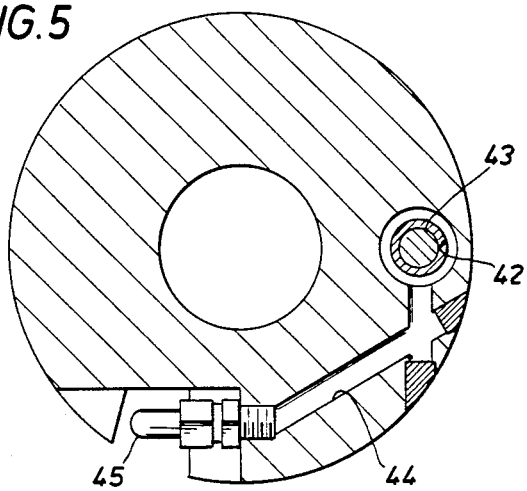
FIG. 5 is a cross sectional view of the assembly, as seen along broken lines 5—5 of FIG. 1A.
Figure 6:
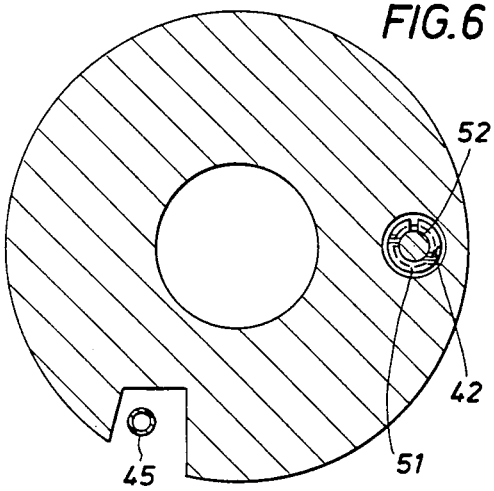
FIG. 6 is a cross sectional view of the assembly, as seen along broken lines 6—6 of FIG. 2A.
Figure 7A:
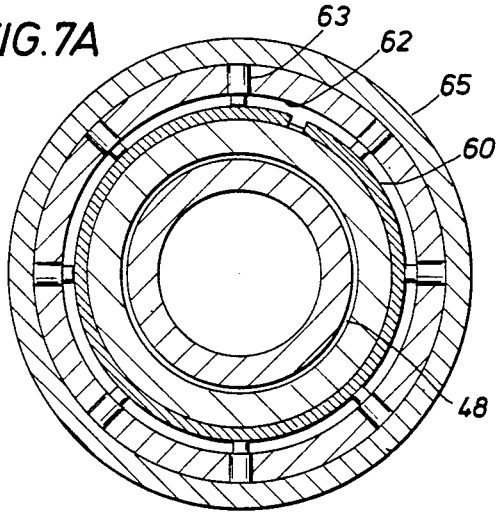
FIGS. 7A and 7B are cross sectional views of the assembly, as seen along broken lines 7A—7A and 7B—7B, respectively, of FIGS. 1B and 2B.
Figure 7B:
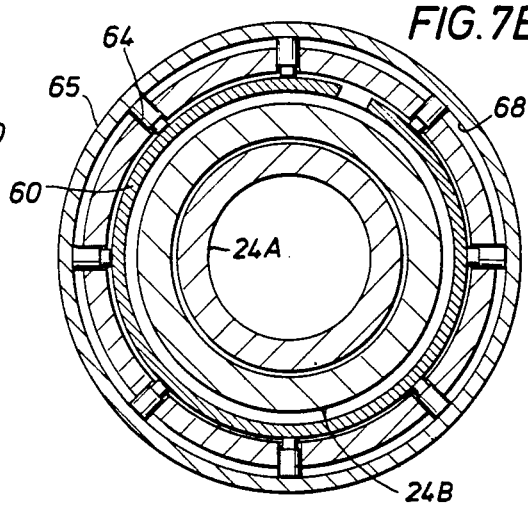
Figure 8A:
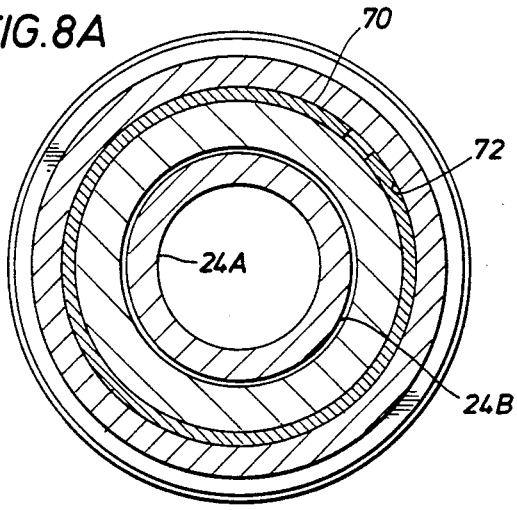
FIGS. 8A and 8B are cross sectional views of the assembly, as seen along broken lines 8A—8A and 8B—8B of FIGS. 1B and 3, respectively.
Figure 8B:
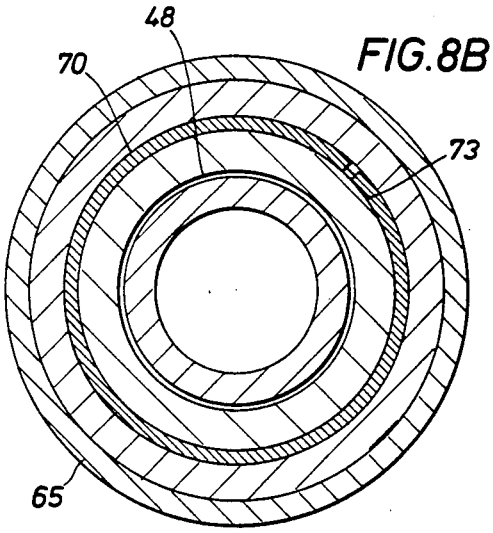

The lower end of a conduit 40 extending downwardly along the well tubing from the surface at the upper end of the well connects with the upper end of a passageway 41 formed within a fitting installed in the enlarged upper portion of the tubular member of the locator seal unit. The lower end of the passageway is enlarged to provide a cylinder 42 in which a closure member 43 is sealably slidable between positions controlling flow from the passageway 41 into a passageway 44 connecting the cylinder with the upper end of another conduit 45 (see FIG. 5) which extends downwardly along the side of the tubular member of the locator seal unit.

The lower end of the external conduit 45 connects with the lower end of another fitting 46 mounted in the tubular member of the locator seal unit and having a bore therethrough adapted to be opened and closed by means of check valves 47. The upper end of the bore opens to an annular passageway 48 formed between inner and outer tubular portions 24A and 24B of the tubular member and extending downwardly through the tubular member and the packer thereabout. The lower end of the annular passageway 48 connects with an annular space providing a chamber 50 between the tubular member and bore of the packer body, and an annular passageway 51 is formed between inner and outer tubular portions 27A and 27B of the packer body to connect the space 50 with the lower end of the annular cylinder 36 in which piston 35 is disposed.

As the assembly is lowered into the well bore, upward movement of the piston is resisted by one or more shear pins 52 connecting the upper end of the piston to the inner tubular portion of the packer body below the body lock ring 37. In addition, with the closure member 43 in its upper closed position, as shown in FIG. 1A, the passageways and cylinder 36 below the closure member are filled with gas at atmospheric pressure, so that the piston 35 is forced by well fluid into its lower position so that the packing element and slips remain in their contracted positions. However, upon lowering the packer to the desired level in the well bore, inhibitor fluid is injected downwardly through the conduit 40 at sufficiently high pressure to open the closure member 43 as well as the balls 47 and thus enter the cylinder 36 in order to shear pins 52 and move the piston 35 upwardly in order to set the packer.

As shown in FIGS. 1A and 2A, the closure member 43 carries seal rings thereabout for sealably sliding within the bore 42 as well as a lower continuation of the bore beneath the fitting. The closure member is initially retained in its upper, closed position, as shown in FIG. 1A, by a shear pin 50 wherein its upper seal ring is above the intersection of passageway 44 with the bore 42. However, upon shearing of the pin, the pressure of the inhibitor fluid above the closure element forces it downwardly to the position shown in FIG. 2A, wherein the upper seal ring about the closure member is below the entry to the passageway 44, thus permitting inhibitor fluid to flow freely into the passageway and thus ultimately into the cylinder 36. Upon opening of the closure element, the operator sees an immediate drop in pressure of the inhibitor fluid and thus knows that the valve has been opened to permit inhibitor fluid to flow downwardly into the cylinder for the setting piston.

The closure member is automatically locked in its lower, open position by means of a C-ring 51 which is carried within the annular space about the bore 42 to surround the closure member, when the closure member is in its upper, closed position, but which is inherently contractable for movement into an annular groove 52 formed about the closure element when the closure element is lowered to its closed position, as shown in FIG. 2A. Thus, when disposed within the groove, the C-ring 51 spans across the adjacent surfaces of the closure element and bore 42 in the fitting so as to prevent the closure member from moving upwardly. Locking of the closure element 43 in its down or open position keeps the seal rings from rubbing within the bores 42 and thus wearing—that is, the seals are static when the closure element is locked in its lower position.

The lower end of the bore 42 connects with a port 53 leading to the bore through the tubular member, and additional seal rings are carried about the lower portion of the closure member for sealably engaging the bore 42 below its intersection with passageway 44 and thus preventing communication between passageway 44 and the bore of the tubular member. With inhibitor fluid disposed within the conduit 40 and passageway 41, the closure element is essentially hydrostatically balanced, and thus will remain in its closed position until the pressure of the inhibitor fluid is raised sufficiently to shear pin 50.

As shown in FIG. 1A, the balls 47 are urged by springs 54 against seats in the fitting installed in the tubular member. When inhibitor fluid is raised to a pressure to open the closure member 43, and thus enter the fitting, it urges the balls upwardly against the force of the springs so as to permit inhibitor fluid to flow therepast into the annular passageway 48. The balls will of course return to their lower closed position, in the event the pressure of inhibitor fluid is lowered below a certain level and thus prevent back flow from the well into the inhibitor injection fluid line.

The tubular member of the locator seal unit is held against downward movement with respect to the packer by means of a C-ring 60 disposed between and spanning the separation between the tubular member and body of the packer. More particularly, the C-ring is shown in FIG. 1A to be disposed vertically between downwardly facing shoulder 61 at the upper end of a reduced diameter portion of the outer portion of the tubular body, and an upwardly facing shoulder at the lower end of an annular groove or recess 62 formed about the bore of the packer body.

The C-ring 60 is inherently outwardly expandable from the position of FIG. 1A, but is retained in its inwardly contracted position by means of pins 63 which extend through holes 64 in the packer body into the groove. The pins are surrounded by a sleeve 65 which surrounds the packer body vertically intermediate the upper slip 31 and a downwardly facing shoulder 66 about the packer body so as to hold the pins inwardly and thus hold the ring 60 contracted. The sleeve 65 is held in the position of FIG. 1B by means of one or more shear pins 67 connecting it to the packer body. Gauge rings 90 and 91 (FIG. 1C) above and below the sleeve have outer diameters greater than that of the sleeve to prevent it from being prematurely released as the packer is lowered into the well bore.

However, when the piston 35 is moved upwardly to axially load the packing element and slips, the upper slip 31 is forced upwardly against the lower end of the sleeve 65 so as to shear the pin 67, and thus move a shoulder on the sleeve upwardly into engagement with the shoulder 66 on the packer body. A groove 68 is formed about the inner diameter of the sleeve 65 for disposal opposite the pins 63, as it is moved upwardly whereby the inherent tendency of the C-ring 60 to expand will push the pins outwardly into the groove 68. The C-ring thus moves outwardly from under the shoulder 61 and into recess 62 to release the locator seal unit for movement downwardly with respect to the packer body, or, of course, conversely, to permit the packer body to move upwardly with respect to the tubular member.

The tubular member is held against upward movement with respect to the packer body by means of another C-ring 70 which is disposed between the tubular member and bore of the packer body in a position to span separation between them. More particularly, the C-ring 70 is disposed between an upwardly facing shoulder 71 about a reduced diameter portion of the tubular member and a downwardly facing shoulder at the upper end of a groove 72 formed about the inner diameter of the packer body.

Figure 3:
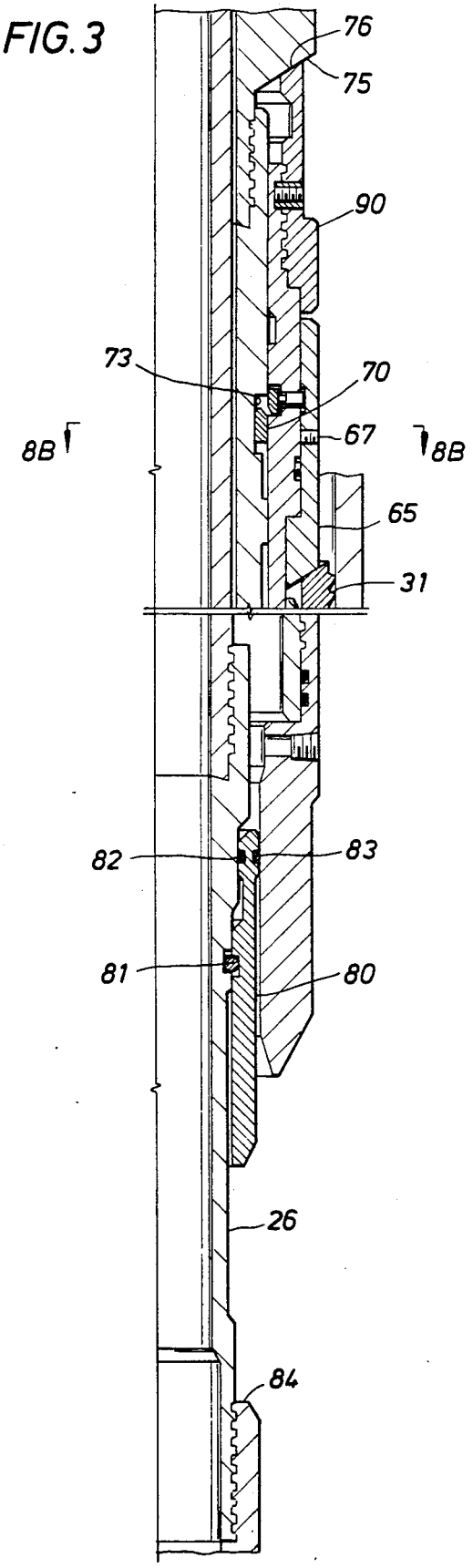
FIG. 3 is a similar view of the assembly, interrupted intermediate its upper and lower ends, and upon lowering of the locator seal unit following setting of the packer, in order to release the tubular member for vertical movement with respect to the packer body.

As illustrated by a comparison of FIGS. 2B and 3, upon release of C-ring 60 from its holding position, and the subsequent downward movement of the inner tubular member with respect to the packer, the inherently contractable C-ring 70 will move radially inwardly into a groove 73 formed about the tubular member above its shoulder 71. More particularly, the groove 73 is of such depth to permit the C-ring 70 to contract inwardly of the inner diameter of the bore of the packer body and thus permit the tubular member to be moved upwardly with respect to the packer body, as can be seen from a comparison of FIGS. 3 and 4. With each of the C-rings 60 and 70 thus released from their holding positions, the tubular member is free to move vertically in either direction with respect to the packer body, and thus expand and contract due to pressure changes in the well bore, and permit the well tubing to be removed from the well bore if desired.

The tubular member of the locator seal unit has an enlarged diameter portion having a downwardly facing shoulder 75 thereon adapted to seat upon an upwardly facing shoulder 76 about the upper end of the packer body, and thereby limit downward movement of the locator seal unit with respect to the packer. As shown in FIG. 3, the shoulders are so spaced apart to permit the tubular member to be moved a distance necessary to dispose groove 73 opposite the seal ring 70 in order to release same. When the packer has been set, as shown in FIGS. 2B and 2C, the packer may be tested by the supply of test pressure to the annulus in the well bore above the packer. This pressure will of course tend to lengthen the well tubing, and thus automatically lower the tubular member of the locator seal unit.

Figure 4:
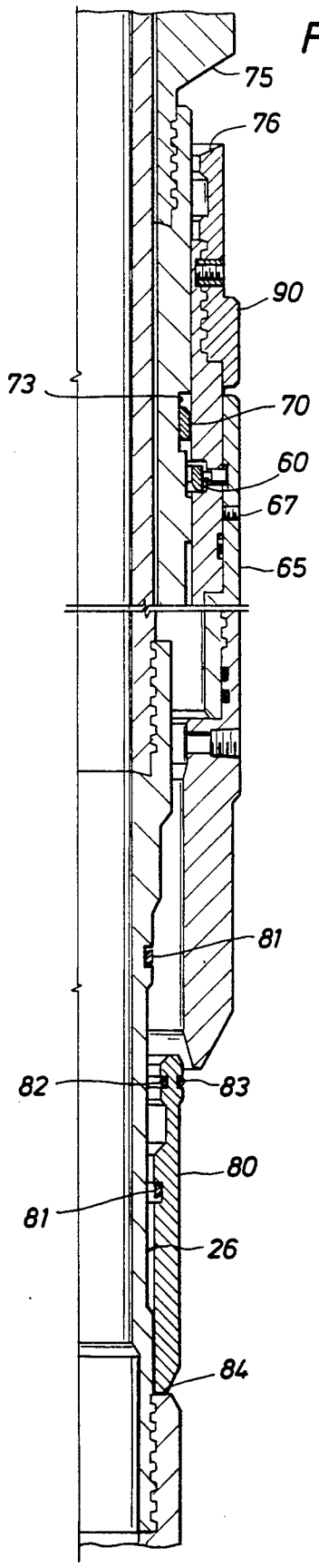
FIG. 4 is another view similar to the FIG. 3, but wherein the pressure of inhibitor fluid supplied to a chamber between the tubular member and packer body has been raised in order to pump out a plug in the chamber and thus permit inhibitor fluid to be circulated therethrough and downwardly within the annulus of the well beneath the set packer.

As shown in FIGS. 1D, 3 and 4, there is an annular opening between the lower end of the packer body and the outer diameter of the tubular member at the lower end of chamber 50, and an annular plug 80 is releasably retained in the opening by means of a shear ring 81 connecting it to the tubular member. More particularly, seal rings 82 and 83 are carried about the inner and outer diameters of the plug for closing off the opening as long as the plug is held therein by the shear pin 81. This of course maintains the lower annular space or chamber 50 closed so as to confine inhibitor fluid for passage upwardly through the passageway 51 into the cylinder 36.

However, following setting of the packer, the pressure of the inhibitor fluid may be raised sufficiently to shear the ring 81 and thus force the plug 80 out of the opening so as to permit inhibitor fluid in chamber 50 to pass downwardly into the annulus of the well bore below the set packer. As shown in FIG. 4, when released from the tubular member, the plug is adapted to be caught upon an upwardly facing shoulder 84 on the upward end of the well tubing connected to the lower end of the tubular member. More particularly, the outer diameter of the plug is smaller than the bore through the packer body so as to permit the plug and thus the well tubing to be pulled upwardly through the packer.

Reviewing now the overall operation of the above described equipment, the packer is initially releasably connected to the locator seal unit in such a manner as to prevent its inadvertent release therefrom prior to initiation of the setting of the packer. Thus, as the assembly is run into the well bore, the C-ring 60 prevents the packer from moving upwardly with respect to the well tubing, as might otherwise occur in the event it is forced through an obstruction in the well bore. In like manner, the C-ring 70 holds the packer against downward movement with respect to the locator seal unit, if, for example, it were necessary to pull the assembly upwardly through an obstruction in the well bore. Thus, and as compared with prior art assemblies of this general type, the connection of the packer to the locator seal unit is independent of the strength of a shear pin connecting the two. Although one or more shear pins 67 connect the sleeve 65 in its lower position, to in turn hold C-ring in the inner positions, such pin is protected against inadvertent shearing by means of the gauge rings 90 and 91 on the packer body above and below the sleeve.

During lowering of the packer into the well bore, the atmospheric pressure within the cylinder 36 and the passageways upstream of it and beneath the closure member 43 prevent inadvertent setting of the packer in that it enables well fluid to maintain the piston 35 in its lower seated position, as shown in FIG. 1C. In order to set the packer, the pressure of inhibitor fluid is increased sufficiently to force closure member 43 downwardly to its lower, locked position, as shown in FIG. 2A, in which it connects passageway 41 with passageway 44. Prior to raising pressure of the inhibitor fluid for this purpose, the closure member is maintained in its closed position not only by the shear pin 50, but also by virtue of the fact that it is essentially pressure balanced with respect to hydrostatic pressure of the fluid in the well tubing and in the inhibitor fluid conduit 40.

Upon opening of the closure member, inhibitor fluid continues to flow downwardly into the fitting in which the ball valves 47 are closed, thus forcing the valves to open positions to permit pressurized inhibitor fluid to continue to flow downwardly through the annular passageway 48 and into the space 50, and then upwardly into cylinder 36 beneath piston 35. This pressure is sufficiently high to shear the pin 52 and overcome the well fluid pressure above the piston to move it upwardly in order to initiate the setting of the packer, but not sufficiently high to shear the pin 81, so that the chamber 50 continues to be closed during this packer setting operation.

As the setting piston 35 moves upwardly, it begins to set the packing element and slips by axially compressing them between its upper end and the lower end of sleeve 65. This of course shears the pins 67 to permit the sleeve to be raised with the packing element and slips until the shoulder of the sleeve engages shoulder 66, following which continued upward movement of the piston further axially compresses the packing element and slips to fully set the packer. During raising of the sleeve 65, the groove 68 is moved opposite the pins 62 to permit them to move outwardly, and thus free the inherently expandable C-ring 60 for movement into the groove 63, thereby releasing the tubular member for downward movement with respect to the packer body. Since ring 70 is holding the tubular member down with respect to the packer body, it absorbs the upward load due to the hydraulic force on the upwardly moving piston 35, and thus permits ring 60 to freely move outwardly into recess as the pins are retracted.

If the packing element and slips set before movement of the recess opposite pins 63, or before the shoulder of sleeve 65 engages shoulder 66, the force of hydraulic fluid on the piston will cause the packer body to move downwardly with respect to the tubular member, thus accomplishing the same result. In the meantime, the upper holding ring 70 is still in place to prevent the locator seal unit from being pulled upwardly out of the packer and thus prevent the packer from being blown off the lower end of the locator seal unit.

Following setting of the packer, it may be tested by the injection of test fluid into the annulus above it. This will stretch the well tubing due to a reverse ballooning effect, and thus lower the locator seal unit to seat 75 on shoulder 76. As previously described, this downward movement of the locator seal unit will automatically dispose groove or recess 73 opposite the inherently contractable C-ring 70, thus releasing the C-ring from holding position, and thereby freeing the locator seal unit for vertical movement in either direction with respect to the set packer.

At this time, the operator would continue to pressure up on the inhibitor fluid so as to shear the pin 81 and thus force the plug 80 out of the annular space in the lower end of the chamber 50. The operator would then note a drastic drop in pressure of the inhibitor fluid as the plug moves out of the space, thereby indicating that inhibitor fluid is circulating downwardly about the tubing below the set packer.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A well packer assembly, comprising a packer adapted to be lowered into a well bore and including a body having a bore therethrough, a packing element and slips carried about the body longitudinally intermediate oppositely facing shoulders and in normally contracted position as the body is lowered into the well bore, means for expanding the packing element and slips into engagement with the well bore including cylinder means and piston means sealably slidable within the cylinder means for moving one of said shoulders toward the other in response to supply of hydraulic pressure to said piston means, and means for automatically locking the packing element and slips in expanded position, and a locator seal unit including a tubular member connectable as part of a well tubing and extending sealably within the bore of the packer body, means connecting the packer body to the tubular member for lowering the packer with the locator seal unit into the well bore, and means for releasing the connection of the packer body to the tubular member in response to setting of the packer and subsequent lowering of the locator seal unit.

2. An assembly of the character defined in claim 1, wherein the connecting means comprises means holding said packer body and tubular member against movement in either one or an opposite longitudinal direction with respect to one another, and the means for releasing the connection of said packer body to said tubular member includes means for releasing the holding means to permit said tubular member to be moved in said opposite longitudinal direction with respect to the body, in response to movement of said piston means to expand the packer, and then permit said tubular member to be moved in said one longitudinal direction with respect to the packer body, in response to movement of said tubular member in said opposite longitudinal direction.

3. An assembly of the character defined in claim 2, wherein said holding means includes first means holding said packer body against movement in the opposite longitudinal direction with respect to the tubular member, and second means holding said packer body against movement in said one longitudinal direction with respect to the tubular member, and said releasing means includes means for releasing said second holding means in response to movement of said piston means in said one longitudinal direction to expand the assembly, and means for releasing said first holding means in response to movement of said tubular member in said opposite longitudinal direction with respect to said body.

4. An assembly of the character defined in 3, wherein said first holding means comprises a first shoulder on the body facing in said opposite direction and a first shoulder on the tubular member facing in said one direction, and a first ring means held between the body and tubular member intermediate the first shoulders, and said second holding means comprises a second shoulder on the body facing in said one direction and a second shoulder on the tubular member facing in said opposite direction, and a second ring held between the body and tubular member intermediate the second shoulder, said tubular member having a recess into which the first ring means may move upon movement of said body in said one direction with respect to the tubular member so as to permit said tubular member to then be moved in said one direction with respect to the body, and said body having a recess into which the second ring means may move upon movement of said expanding means in said one direction with respect to the body so as to then permit said tubular member to move in said opposite direction with respect to the body.

5. An assembly of the character defined in claim 4, wherein said second ring means comprises a C-ring inherently expandable from an inner position to an outer position within the recess of the body, and said means for releasing the C-ring comprises pins extending through the packer body and into the recess in the body for engaging said C-ring, and a sleeve releasably connected about the body intermediate the packing element and slips and the other shoulder of the body to radially confine the pins and thus retain the C-ring in retracted position, and having a recess into which the pins are moved by said expanding C-ring when said sleeve is moved vertically in said one direction with respect to the body by movement of said packing element and slips in said one longitudinal direction, and said first ring means comprises another C-ring which is inherently retractable from an inner position into the recess in the tubular member when opposite thereto, and said packer body has gauge surfaces thereabout which project radially outwardly beyond the sleeve to protect said sleeve against inadvertent release of its connection to the packer body during reciprocation of the packer within the well bore.

6. An assembly of the character defined in claim 5, wherein the piston means is movable upwardly in response to the supply of hydraulic fluid to its lower end, and the other shoulder of the packer body faces downwardly to limit upward movement of the sleeve.

7. A well packer assembly, comprising a packer adapted to be lowered into a well bore and including a body having a bore therethrough, a packing element and slips carried about the body in normally contracted positions as the body is lowered into the well bore, piston means sealably slidably within cylinder means in the packer body in one direction to expand the packing element and slips, and means for automatically locking the packing element and slips in expanded position, and a locator seal unit including a tubular member connectable as part of a well tubing and extending sealably within the bore of the packer body, and means releasably connecting the tubular member to the packer body for lowering the packer with the locator seal unit into the well bore, means including conduit means external to the bore of the tubular member for introducing inhibitor fluid from a source at the surface into a fluid chamber which connects with the cylinder means in order to move the piston means in said one direction, and means for releasing inhibitor fluid for flow from the chamber into the annulus beneath the packer in response to raising of the pressure of inhibitor fluid in the chamber to a level above that required to expand the packing element and slips.

8. An assembly of the character defined in claim 7, wherein said releasing means comprises a plug held within an opening connecting the chamber with the well bore beneath the expanded packing element, but releasable therefrom responsive to said rise in pressure.

9. An assembly of the character defined in claim 8, wherein the opening is an annular space, and the plug is an annular sleeve sealably slidable within the space, and the releasably holding means comprises shear means connecting the sleeve to one of the tubular member and packer body.

10. An assembly of the character defined in claim 9, wherein the opening is formed between the tubular member and body, and the sleeve has an outer diameter which is less than the inner diameter of the bore of the packer body to permit it to be raised with the well tubing from within the bore of the packer body.

11. An assembly of the character defined in claim 10, wherein said locator seal unit includes valve means which is normally held in a position closing said opening to contain gas at atmospheric pressure between said valve means and piston means so that the piston means is urged in an opposite direction by the fluid in the well bore, and which is releasable for movement to open position in response to an increase in pressure of the inhibitor fluid.

12. An assembly of the character defined in claim 11, including means for automatically holding the valve means in its open position.

13. An assembly of the character defined in claim 12, wherein said valve means includes a closure member sealably slidable within a bore connecting the passageway means with the bore of the tubular member.

14. A well packer assembly, comprising a packer adapted to be lowered into a well bore and including a body having a bore therethrough, a packing element and slips carried about the body longitudinally intermediate oppositely facing shoulders and in normally contracted positions as the body is lowered into the well bore, a locator seal unit including a tubular member connectable as part of a well tubing and extending sealably within the bore of the packer body, means connecting the packer body to the tubular member for lowering the packer with the locator seal unit into the well bore, means for expanding the packing element and slips into engagement with the well bore including cylinder means and piston means sealably slidable within the cylinder means for moving one of said shoulders toward the other in response to supply of hydraulic pressure to said piston means, means for automatically locking the packing element and slips in expanded position, and means for releasing the connection of the packer body to the tubular member in response to setting of the packer and subsequent lowering of the locator seal unit.

15. An assembly of the character defined in claim 14, wherein the connecting means comprises means holding said packer body and tubular member against movement in either one or an opposite longitudinal direction with respect to one another, and the means for releasing the connection of said packer body to said tubular member includes means for releasing the holding means to permit said tubular member to be moved in said opposite longitudinal direction with respect to the body, in response to movement of said position means to expand the packer, and then permit said tubular member to be moved in said one longitudinal direction with respect to the packer body, in response to movement of said tubular member in said opposite longitudinal direction.

16. An assembly of the character defined in claim 15, wherein said holding means includes first means holding said packer body against movement in the opposite longitudinal direction with respect to the tubular member, and second means holding said packer body against movement in said one longitudinal direction with respect to the tubular member, and said releasing means includes means for releasing said second holding means in response to movement of said piston means in said one longitudinal direction to expand the assembly, and means for releasing said first holding means in response to movement of said tubular member in said opposite longitudinal direction with respect to said body.

17. An assembly of the character defied in claim 16, wherein said first holding means comprises a first shoulder on the body facing in said opposite direction and a first shoulder on the tubular member facing in said one direction, and a first ring means held between the body and tubular member intermediate the first shoulders, and said second holding means comprises a second shoulder on the body facing in said one direction and a second shoulder on the tubular member facing in said one opposite direction, and a second ring held between the body and tubular member intermediate the second shoulder, said tubular member having a recess into which the first ring means may move upon movement of said body in said one direction with respect to the tubular member so as to permit said tubular member to then be moved in said one direction with respect to the body, and said body having a recess into which the second ring means may move upon movement of said expanding means in said one direction with respect to the body so as to then permit said tubular member to move in said opposite direction with respect to the body.

18. An assembly of the character defined in claim 17, wherein said second ring comprises a C-ring inherently expandable from an inner position to an outer position within the recess of the body, and said means for releasing the C-ring comprises pins extending through the packer body and into the recess in the body for engaging said C-ring, and a sleeve releasably connected about the body intermediate the packing element and slips and the other shoulder of the body to radially confine the pins and thus retain the C-ring in retracted position, and having a recess into which the pins are moved by said expanding C-ring when said sleeve is moved vertically in said one direction with respect to the body by movement of said packing element and slips in said one longitudinal direction, and said first ring means comprises another C-ring which is inherently retractable from an inner position into the recess in the tubular member when opposite thereto, and said packer body has gauge surfaces thereabout which project radially outwardly beyond the sleeve to protect said sleeve against inadvertent release of its connection to the packer body during reciprocation of the packer within the well bore.

19. An assembly of the character defined in claim 18, wherein the piston means is movable upwardly in response to the supply of hydraulic fluid to its lower end, and the other shoulder of the packer body faces downwardly to limit upward movement of the sleeve.

* * * * *